US006386555B1

(12) United States Patent
Kao

(10) Patent No.: US 6,386,555 B1
(45) Date of Patent: May 14, 2002

(54) ROLLER SKATE STRUCTURE

(75) Inventor: Gang-Fu Kao, Changhua (TW)

(73) Assignee: Phoebe & George Enterprise Co., Ltd., Changhua (TW)

( * ) Notice: Subject to any disclaimer, the term of this patent is extended or adjusted under 35 U.S.C. 154(b) by 0 days.

(21) Appl. No.: 09/788,375

(22) Filed: Feb. 21, 2001

(51) Int. Cl.[7] ..... A63C 17/00; A63C 17/20

(52) U.S. Cl. ..... 280/7.13; 280/841; 280/11.27; 280/11.204; 280/11.19; 36/115

(58) Field of Search ..... 280/7.1, 11.224, 280/11.23, 7.13, 841, 843, 7.17, 11.19, 11.204–11.232, 11.27, 11.26, 811; 36/113, 114, 115, 116, 118.9, 61; 482/77; 188/5

(56) References Cited

U.S. PATENT DOCUMENTS 3,983,643 A * 10/1976 Schreyer et al. ..... 36/115
5,398,970 A * 3/1995 Tucky ..... 280/841
5,511,824 A * 4/1996 Kim ..... 280/11.19
6,120,039 A * 9/2000 Clementi ..... 280/11.19
6,247,708 B1 * 6/2001 Hsu ..... 280/7.13
6,308,964 B1 * 10/2001 Chang ..... 280/7.13

* cited by examiner

*Primary Examiner*—Douglas C. Butler
(74) *Attorney, Agent, or Firm*—Troxell Law Office PLLC

(57) ABSTRACT

Roller skate structure including a locating seat assembly composed of a locating seat, two nuts, a linking plate, a stop body, a compression spring, a torque spring, a pivot shaft and a C-shaped retainer ring. Two pivot plates downward extend from the locating seat. A lateral end of each pivot plate is formed with a stop through hole. A middle portion of each pivot plate is formed with a pivot hole. One side of one pivot plate is provided with a projecting post having a slide through hole. Two ends of the linking plate are respectively formed with a driving hole and a driven hole. The stop body includes a stop head and a small diameter driven post extending from the end face of the stop head. The pivot shaft is a two-step cylindrical member. The circumference of the large diameter section of the pivot shaft is formed with a spring hooking hole. The circumference of the small diameter section thereof is cut with a plane linking face. An inner end of the pivot shaft being formed with an annular retainer groove.

1 Claim, 5 Drawing Sheets

ROLLER SKATE STRUCTURE

BACKGROUND OF THE INVENTION

The present invention is related to an improved roller skate structure which has less components so that the manufacturing cost is relatively low. The time for assembling the components is shortened. When turning or pressing the components, the less transmission components will not distribute the transmission force so that the transmission can be truly achieved.

FIG. 1 shows a conventional roller skate including a boot 10, two press caps 16, two thrust bolts 17, two locating seat assemblies 20 and two roller seats 31. The front and rear portions of bottom side of the boot 10 are respectively formed with two cavities 11. A reinforcing plate 12 is embedded in the top face of each cavity 11. Each reinforcing plate 12 is formed with four locking holes 13. The front and rear ends of the bottom face of the boot 10 are provided with brake blocks 14. A lateral side of the boot 10 is formed with two two-step through holes 15 communicating with the cavities 11. The press cap 16 is circular, having a diameter slightly smaller than the large diameter of the two-step through hole 15. The press cap 16 has a certain elasticity and flexibility. The outer diameter of the thread section of the thrust bolt 17 is slightly smaller than the small diameter of the two-step through hole 15. The locating seat assembly 20 is composed of a locating seat 21, a pivot shaft 22, a torque spring 23, a C-shaped retainer ring 24, a restoring spring 25, a restricting pin 26, a compression spring 27, a locking member 28, a driving plate 29 and a biased block 30. Each of four corners of a locating board of the locating seat 21 is formed with a locking hole 211. Two pivot plates 212 downward extend from bottom face of the locating seat 21 opposite to each other. The two pivot plates 212 define therebetween a space. The middle of each pivot plate 212 is formed with a pivot hole 213. One side of one pivot plate 212 is provided with an outward extending fitting post 214 and a locking boss 215. The locking boss 215 is formed with a thread hole 216 passing through the pivot plate 212. The pivot shaft 22 is a two-step cylindrical member. The circumference of the large diameter section of the pivot shaft 22 is formed with a spring hooking hole 221. The circumference of the small diameter section thereof is cut with a plane linking face 222. The inner end is formed with an annular retainer groove 223. The restricting pin 26 is a two-step member. The large diameter section thereof is formed as a stop head 261. The end of the small diameter section thereof is formed with an outer thread 262 with a certain length. The locking member 28 is a two-step member. The small diameter section thereof is formed with an outer thread 281. The end face is formed with a two-step hole 282. One end of the driving plate 29 is formed with a driving restricting hole 291. The other end thereof is formed with a linking hole 292. The biased member 30 is also a two-step member. The large diameter section thereof is formed as a biased head 301. The end of the small diameter section thereof is formed with a thread hole 302 with a certain depth. The roller seat 31 is composed of a pivot seat 311 and two rollers 312 pivotally connected with two sides of rear end of the pivot seat 311. The front end of the pivot seat 311 is formed with a central transmission hole 313. One side of the circumference of the transmission hole 313 is formed with a plane section. A certain portion of the circumference of the front end of the pivot seat 311 is formed with an insertion notch 314.

When assembled, as shown in FIG. 2, the pivot seat 311 of the roller seat 31 is first fitted between the two pivot plates

212 of the locating seat 21. The pivot shaft 22 is passed through the torque spring 23 and then passed through the pivot holes 213 of the locating seat 21 and the transmission hole 313 of the roller seat 31 to extend out of the inner pivot plate 212 of the locating seat 21 by a certain length. At this time, the C-shaped retainer ring 24 is fitted into the retainer groove 223 of the pivot shaft 22. One end of the torque spring 23 is hooked into the hooking hole 221 of the pivot shaft 22, while the other end thereof is leant against the locating board of the locating seat 21, whereby the pivot shaft 22 is pivotally connected on the locating seat 21. The roller seat 31 is also connected with the pivot shaft 22. When the roller seat 31 is rotated, via the transmission hole 313 of the roller seat 31 and the transmission face 222 of the pivot shaft 22, the pivot shaft 22 is rotated along with the roller seat 31. Two ends of the torque spring 23 are tensioned and compressed. Then, the compression spring 27 is fitted onto the small diameter section of the restricting pin 26 with one end leant against the end face of the stop head 261. Then, the small diameter section of the restricting pin 26 is fitted into the two-step hole 282 of the locking member 28. The outer thread 262 extends out of the end face of the large diameter section of the locking member 28 and the linking hole 292 of the driving plate 29. The other end of the compression spring 27 is leant against the end face of the large diameter section of the two-step hole 282. The stop head 261 extends out of the end face of small diameter section of the locking member 28. When subject to a pressing force, the stop head 261 can be moved retracted into the two-step hole 282 of the locking member 28. Then, the outer thread 262 is screwed into the thread hole 302 of the biased member 30. Accordingly, the restricting pin 26 passes through the driving plate 29 and the driving plate 29 is clamped between the locking member 28 and the biased member 30. Then, the restoring spring 25 is fitted on the fitting post 214 of the locating seat 21. The outer thread 281 of the locking member 28 is screwed into the thread hole 216 of the locating seat 21. At this time, the stop head 261 fitted in the locking member 28 is pressed by the pivot seat 311 of the roller seat 31 and slided into the two-step hole 282 of the locking member 28. Also, the compression spring 27 is compressed by the stop head 261 and the two-step hole 282. Moreover, two ends of the restoring spring 25 are respectively leant against the face of the driving plate 29 and the pivot plate 212 of the locating seat 21. Then, the thrust bolt 17 and the press cap 16 are sequentially fitted into the two-step through hole 15 of the boot 10. The thread section of the thrust bolt 17 extends into the cavity 11 by a certain length and screwed into a washer and a nut. Thereafter, the thrust bolt 17 extends out of the end face of the nut by a certain length. At this time, the locating seat 21 is fitted into the cavity 11 of the boot 10 and the thrust bolt 17 is fitted into the driving restricting hole 291 of the driving plate 29. One end of the nut is attached to the face of the driving plate 29. Finally, a bolt is passed through the locking hole 13 of the boot 10 to be locked in the locking hole 211 of the locating seat 21. Under such circumstance, the locating seat 21 together with the roller seat 31 is located in the cavity 11 and the assembly is completed..

When it is desired to turn the roller seat 31 to convert the boot 10 into a roller skate as shown in FIG. 3, a user needs to extend his/her hand into the cavity 11 of the boot 10 and downward turn the roller seat 31. When turning the roller seat 31, by means of the transmission hole 313, the pivot shaft 22 will be rotated along with the roller seat 31. When the pivot shaft 22 is driven, the torque spring 23 is compressed. When the insertion notch 314 of the roller seat 31 is aligned with the thread hole 216 of the locating seat 21, the stop head 261 of the restricting pin 26 is free from the stop of the pivot seat 311 of the roller seat 31 so that the compression spring 27 resiliently restores to snap the stop head 261 into the insertion notch 314 of the roller seat 31. At this time, the roller seat 31 is engaged with and stopped by the stop head 261 and is prevented from turning back after released by the hand. When the stop head 261 snaps into the insertion notch 314, the restricting pin 26 is driven to inward pull the biased member 30 and make the biased head 301 thereof attach to the driving plate 29. Under such circumstance, the boot 10 is converted into a roller skate. When it is desired to turn up the roller seat 31 to convert the roller skate back into a boot as shown in FIG. 2, the user needs to press the press cap 16 with one hand to retract the thrust bolt 17. At this time, the nut screwed with the thrust bolt 17 will inward push the driving plate 29 and make the end with the linking hole 292 biased outward. The biased member 30 is together outward transversely moved. At this time, the stop head 261 of the restricting pin 26 will be again driven to slide into the two-step hole 282. Under such circumstance, the insertion notch 314 of the roller seat 31 is disengaged from the stop head 261 and resiliently driven by the torque spring 23 and restored to its home position along with the pivot shaft 22. Accordingly, the roller skate is converted back into a boot 10.

The above conventional roller skate has some shortcomings as follows:

1. The locating seat assembly 20 has a number of components so that the manufacturing cost is relatively high.
2. It is time-consuming and troublesome to assemble so many components.
3. It is impossible to mass-produce the conventional roller skate so that the competitive ability of the products on market will be poor.
4. When turning or pressing the components, the numerous transmission components will distribute the transmission force so that the transmission can be hardly truly achieved.

SUMMARY OF THE INVENTION

It is therefore a primary object of the present invention to provide a roller skate structure in which the locating seat assembly has less components so that the manufacturing cost is relatively low.

It is a further object of the present invention to provide the above roller skate structure in which there are less components so that the time for assembling the components is shortened and the assembling procedure is simplified.

It is still a further object of the present invention to provide the above roller skate structure in which it is possible to mass-produce the conventional roller skate so that the competitive ability of the products on market is enhanced.

It is still a further object of the present invention to provide the above roller skate structure in which when turning or pressing the components, the less transmission components will not distribute the transmission force so that the transmission can be truly achieved.

The present invention can be best understood through the following description and accompanying drawings wherein:

DETAILED DESCRIPTION OF THE PREFERRED EMBODIMENT

Figure 1:
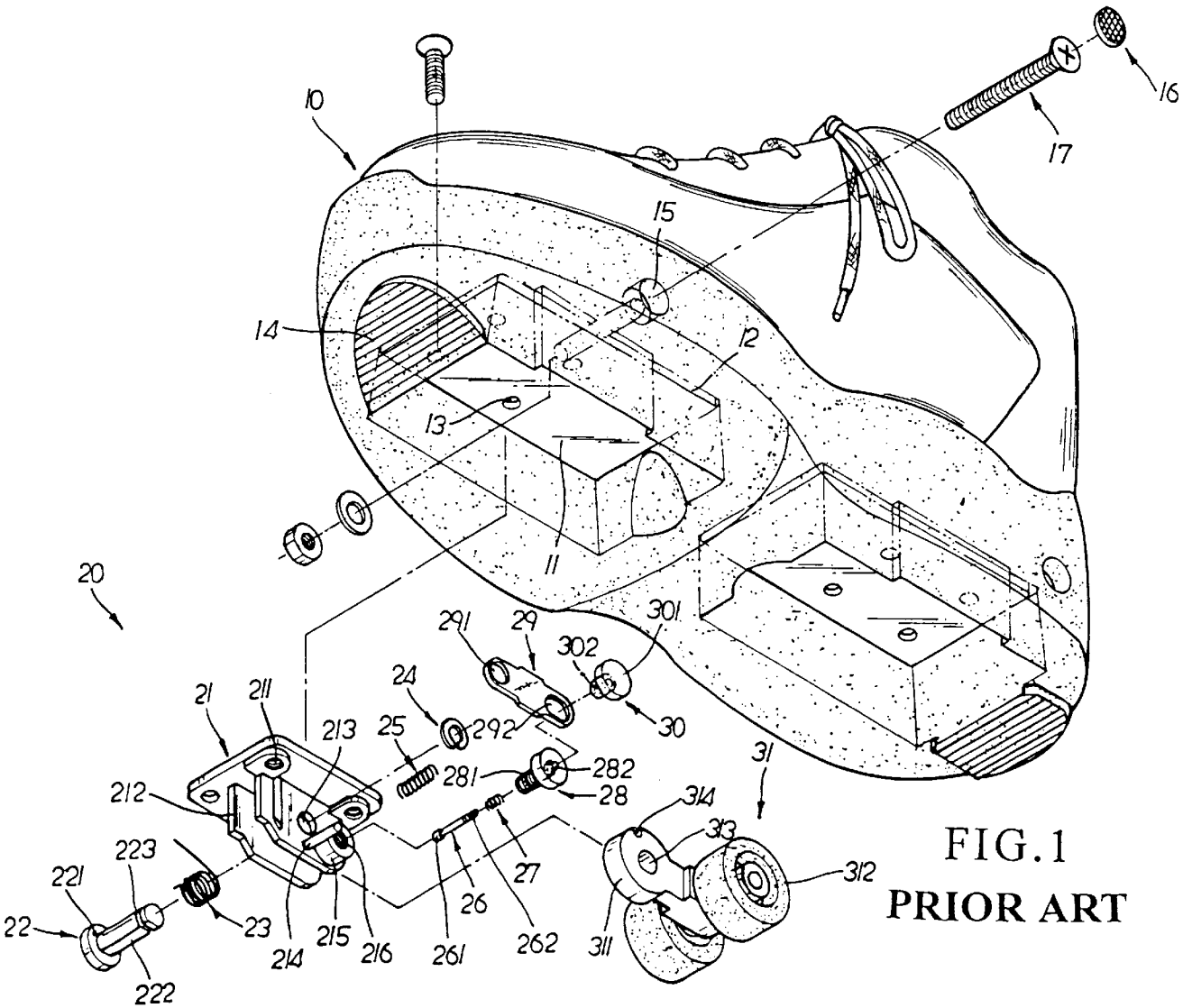
FIG. 1 PRIOR ART
FIG. 1 is a perspective exploded view of a conventional roller skate.
Figure 2:
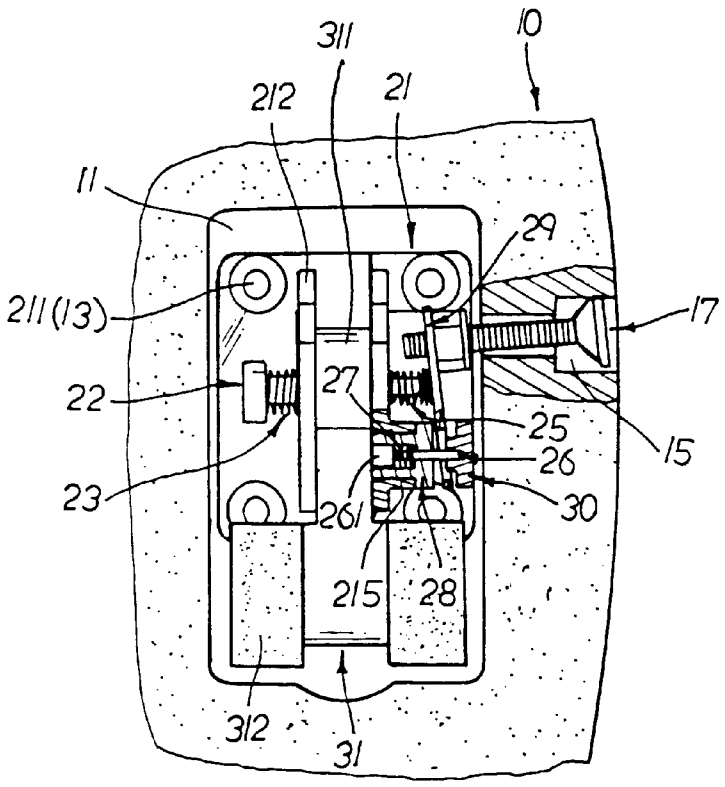
FIG.2 PRIOR ART
FIG. 2 is a plane assembled view of the conventional roller skate, showing the pressing operation thereof.
Figure 3:
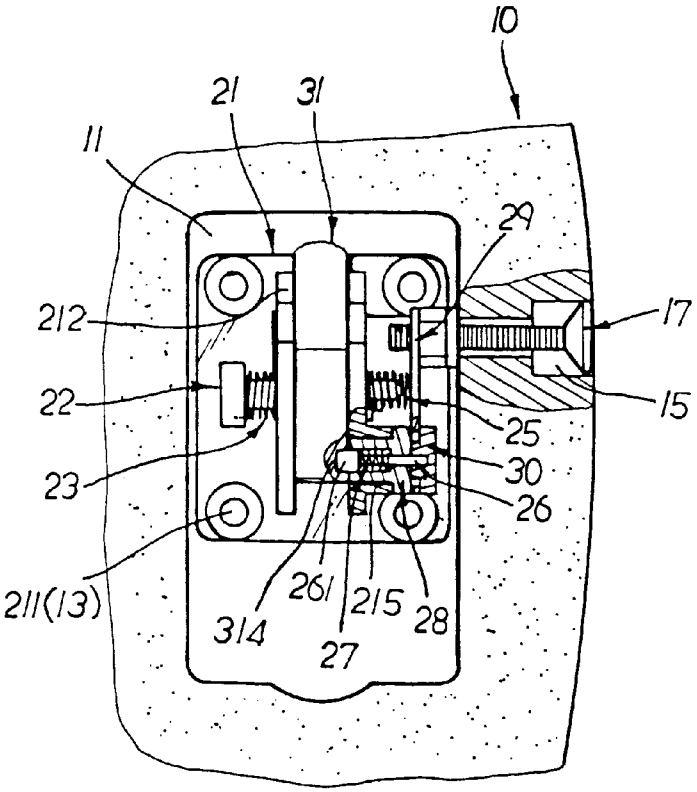
FIG.3 PRIOR ART
FIG. 3 is a plane assembled view of the conventional roller skate in which the boot is converted into a roller skate.
Figure 4:
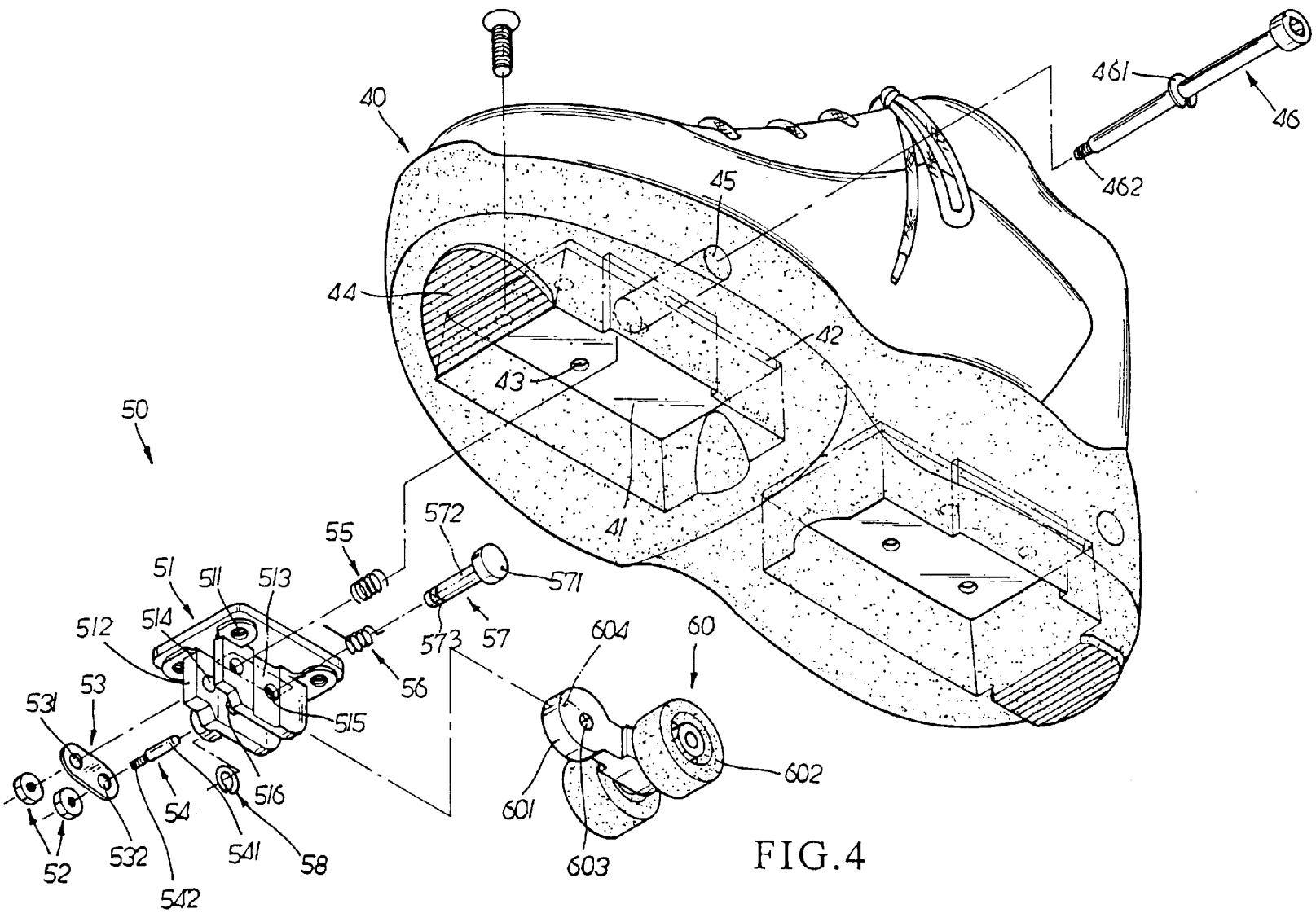
FIG. 4 is a perspective exploded view of the roller skate of the present invention.

Please refer to FIG. 4. The roller skate structure of the present invention includes a boot 40, two press rods 46, two locating seat assemblies 50 and two roller seats 60. The front and rear portions of bottom side of the boot 40 are respectively formed with two cavities 41. A reinforcing plate 42 is embedded in the top face of each cavity 41. Each reinforcing plate 42 is formed with four locking holes 43. The front and rear ends of the bottom face of the boot 40 are provided with brake blocks 44. A lateral side of the boot 40 is formed with two through holes 45 communicating with the cavities 41. The through hole 45 has a diameter larger than the maximum diameter of the press rod 46. The press rod 46 is two-stepped. A stop ring 461 is retained around the outer circumference of the small diameter section of the press rod 46. The end of the press rod 46 has an extending driving post 462 formed with outer thread and having a minimum diameter of the press rod 46. The locating seat assembly 50 is composed of a locating seat 51, two nuts 52, a linking plate 53, a stop body 54, a compression spring 55, a torque spring 56, a pivot shaft 57 and a C-shaped retainer ring 58. Each of four corners of a locating board of the locating seat 51 is formed with a locking hole 511. Two pivot plates 512 downward extend from bottom face of the locating seat 51 opposite to each other. The two pivot plates 512 define therebetween a space. The locating board is formed with an escape slot 513 in the space. A lateral end of each pivot plate 512 is formed with a stop through hole 514. The middle of the pivot plate is formed with a pivot hole 515. One side of one pivot plate 512 is provided with a projecting post formed with a slide through hole 516 extending through the pivot plate 512. The linking plate 53 has a certain length and a certain thickness. Two ends thereof are respectively formed with a driving hole 531 and a driven hole 532. The driving hole 531 has a diameter slightly larger than the outer diameter of the driving post 462 of the press rod 46. The stop body 54 includes a bullet-like stop head 541 and a driven post 542 extending from the end face of the stop head 541. The driven post 542 has smaller diameter and is formed with outer thread. The stop head 541 has an outer diameter slightly smaller than the diameter of the driven hole 532 of the linking plate 53. The pivot shaft 57 is a two-step cylindrical member. The circumference of the large diameter section of the pivot shaft 57 is formed with a spring hooking hole 571. The circumference of the small diameter section thereof is cut with a plane linking face 572. The inner end of the pivot shaft 57 is formed with an annular retainer groove 573. The roller seat 60 is composed of a pivot seat 601 and two rollers 602 pivotally connected with two sides of rear end of the pivot seat 601. The front end of the pivot seat 601 is formed with a central transmission hole 603. One side of the circumference of the transmission hole 603 is formed with a plane section. A certain portion of the circumference of the front end of the pivot seat 601 is formed with an insertion notch 604.

Figure 5:
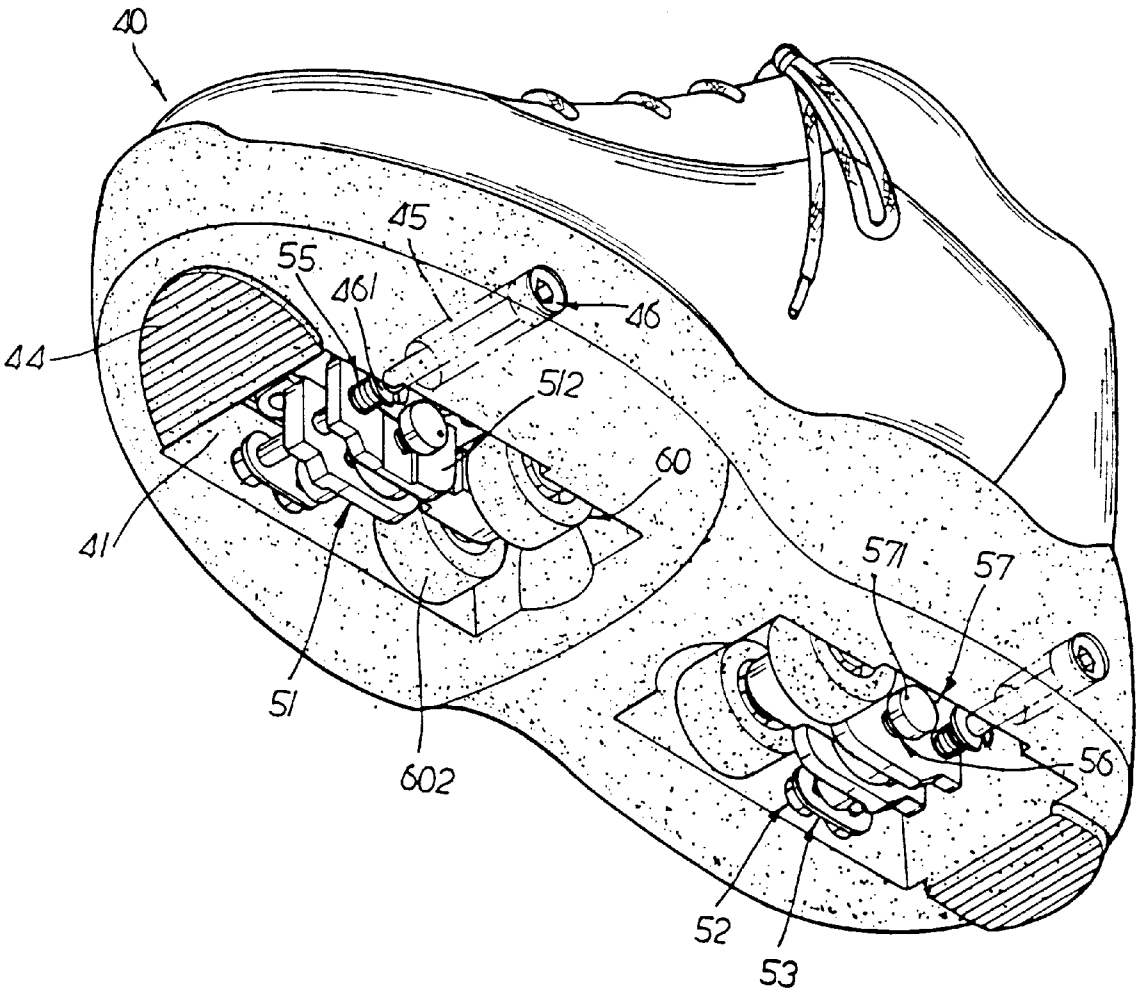
FIG. 5 is a perspective assembled view of the roller skate of the present invention.
Figure 6:
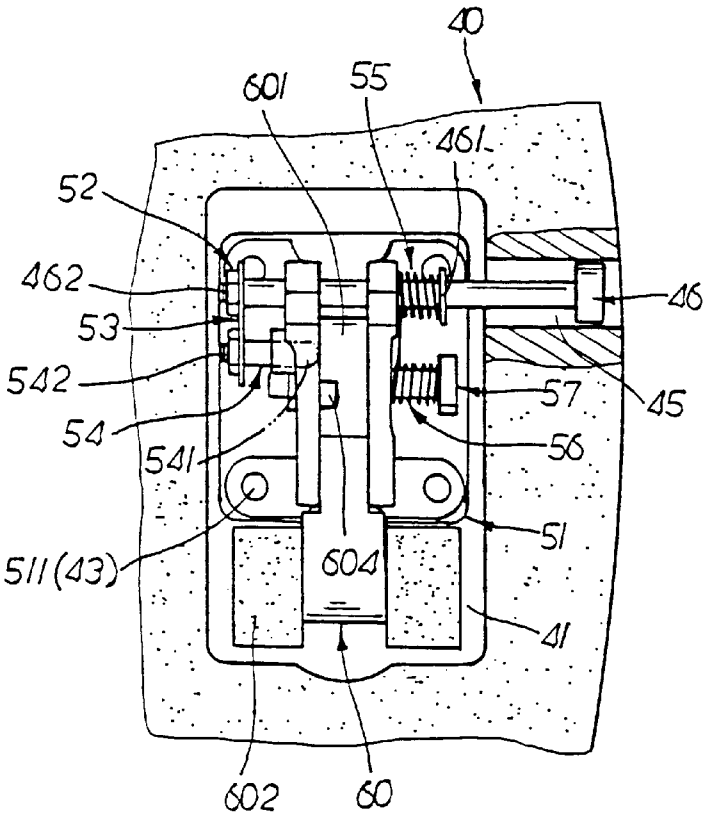
FIG. 6 is a plane assembled view of the roller skate of the present invention.

When assembled, as shown in FIGS. 5 and 6, the pivot seat 601 of the roller seat 60 is first fitted between the two pivot plates 512 of the locating seat 51. The pivot shaft 57 is passed through the torque spring 56 and then passed through the pivot holes 515 of the locating seat 51 and the transmission hole 603 of the roller seat 60 to extend out of the outer pivot plate 512 of the locating seat 51 by a certain length. At this time, the C-shaped retainer ring 58 is retained in the retainer groove 573 of the pivot shaft 57. One end of the torque spring 56 is hooked into the hooking hole 571 of the pivot shaft 57, while the other end thereof is leant against the locating board of the locating seat 51, whereby the pivot shaft 57 is pivotally connected on the locating seat 51. The roller seat 60 is also connected with the pivot shaft 57. When the roller seat 60 is rotated, via the transmission hole 603 of the roller seat 60 and the transmission face 572 of the pivot shaft 57, the pivot shaft 57 is rotated along with the roller seat 60. Two ends of the torque spring 56 are tensioned and compressed. When not subject to rotating force, the torque spring 56 resiliently forces the roller seat 60 to prevent the same from being freely rotated. Then, the locating seat 51 is fitted into the cavity 41 of the boot 40 with the stop through hole 514 aligned with the through hole 45 of the boot 40. Then, the compression spring 55 is fitted on the small diameter section of the press rod 46. One end of the compression spring 55 is leant against the end face of the stop ring 461. The press rod 46 with the compression spring 55 is fitted into the through hole 45 of the boot 40 with the compression spring 55 and the stop ring 461 extending into the cavity 41. Also, the small diameter section and the driving post 462 are fitted into the stop through hole 514 of the locating seat 51 and extent out of the outer pivot plate 512 of the locating seat 51 by a certain length. The other end of the compression spring 55 is leant against the face of the pivot plate 512 of the locating seat 51. Then, the stop head 541 of the stop body 54 is fitted into the slide through hole 516 of the locating seat 51 and the driving post 462 is fitted into the driving hole 531 of the linking plate 53 and the driven post 542 is fitted into the driven hole 532. Two nuts 52 are screwed onto the driving post 462 and the driven post 542, whereby the linking plate 53 is located on the press rod 46 and the stop body 54. By means of the bridging of the linking plate 53, the press rod 46 and the stop body 54 can be synchronously slided and moved. After the stop head 541 of the stop body 54 is fitted into the slide through hole 516, the stop head 541 is stopped by the pivot seat 601 of the roller seat 60 and prevented from further extending inward. At this time, the press rod 46 is driven by the stop body 54 and the linking plate 53 to slightly move inward. Also, the compression spring 55 is tensioned and compressed by the stop ring 461 and the pivot plate 512. Finally, a bolt is passed through the locking hole 43 of the boot 40 to be locked in the locking hole 511 of the locating seat 51. Under such circumstance, the locating seat 51 together with the roller seat 60 is located in the cavity 41 and the assembly is completed.

Figure 7:
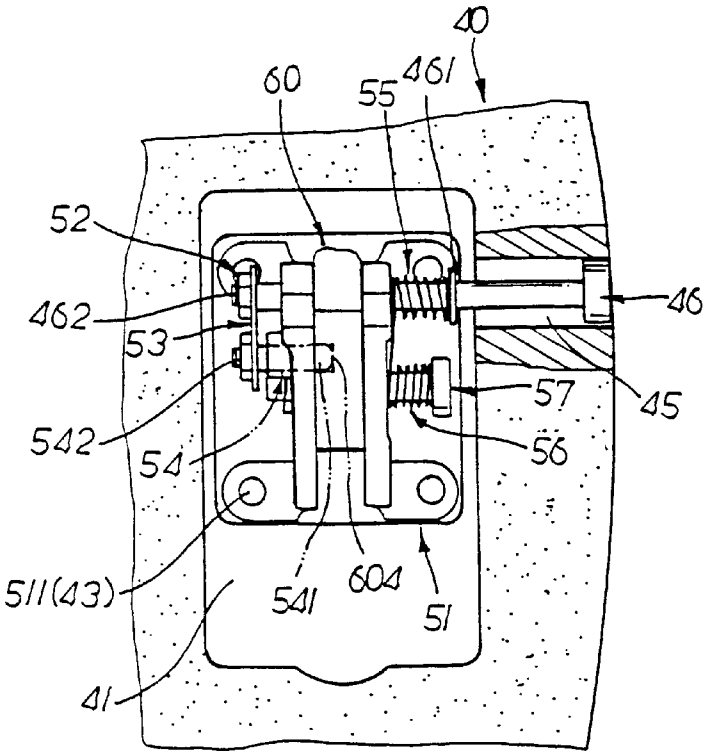
FIG. 7 is a plane assembled view of the roller skate of the present invention in which the boot is converted into a roller skate.

When it is desired to turn the roller seat 60 downward to convert the boot 40 into a roller skate as shown in FIG. 7, a user needs to extend his/her hand into the cavity 41 of the boot 40 and downward turn the roller seat 60. When turning the roller seat 60, by means of the transmission hole 603, the pivot shaft 57 will be rotated along with the roller seat 60. When the pivot shaft 57 is driven, the torque spring 56 is compressed. When the insertion notch 604 of the roller seat 60 is aligned with the slide through hole 516 of the locating seat 51, the stop head 541 of the stop body 54 is free from the stop of the pivot seat 601 of the roller seat 60 so that the compression spring 55 resiliently restores to outward push the press rod 46. By means of the transmission of the linking plate 53, the stop head 541 snaps into the insertion notch 604 of the roller seat 60. At this time, the roller seat 60 is engaged with and stopped by the stop head 541 and is prevented from turning back after released by the hand. When the stop head 541 entirely snaps into the insertion notch 604, the press rod 46 is prevented from further moving outward and the large diameter section thereof is totally flush with the end face of the through hole 45 of the boot 40. Accordingly, the pressing operation can be quickly and easily performed. Under such circumstance, the boot 40 is converted into a roller skate. When it is desired to turn up the roller seat 60 to convert the roller skate into a boot 40, the user needs to press and retract the press rod 46 with one hand. At this time, the driving post 462 will push the linking plate 53 to make the stop body 54 move along with the press rod 60. After the stop head 541 is totally slided out of the insertion notch 604 of the roller seat 60, the compression spring 55 is again tensioned and compressed by the stop ring 461 and pivot plate 512 and the roller seat 60 is disengaged from the stop head 541 and resiliently driven by the torque spring 56 and restored to its home position along with the pivot shaft 57. Accordingly, the roller skate is converted back into a boot 40.

According to the above arrangement, the present invention has the following advantages:

1. The locating seat assembly 50 has less components so that the manufacturing cost is relatively low.
2. There are less components so that the time for assembling the components is shortened and the assembling procedure is simplified.
3. It is possible to mass-produce the conventional roller skate so that the competitive ability of the products on market is increased.
4. When turning or pressing the components, the less transmission components will not distribute the transmission force so that the transmission can be truly achieved.

The above embodiment is only used to illustrate the present invention, not intended to limit the scope thereof. Many modifications of the above embodiment can be made without departing from the spirit of the present invention.

What is claimed is:

1. Roller skate structure comprising a boot, two press rods, two locating seat assemblies and two roller seats, a front and a rear portions of bottom side of the boot being respectively formed with two cavities, a reinforcing plate being embedded in a top face of each cavity, each reinforcing plate being formed with locking holes, a front and a rear ends of the bottom face of the boot being provided with brake blocks, the locating seat assembly being composed of a locating seat, two nuts, a linking plate, a stop body, a compression spring, a torque spring, a pivot shaft and a C-shaped retainer ring, each of four corners of a locating board of the locating seat being formed with a locking hole, two pivot plates downward extending from bottom face of the locating seat to define therebetween a space, a middle portion of each pivot plate being formed with a pivot hole, one side of one pivot plate being provided with a projecting post, the pivot shaft being a two-step cylindrical member, the circumference of the large diameter section of the pivot shaft being formed with a spring hooking hole, the circumference of the small diameter section thereof being cut with a plane linking face, an inner end of the pivot shaft being formed with an annular retainer groove, the roller seat being composed of a pivot seat and two rollers pivotally connected with two sides of rear end of the pivot seat, a front end of the pivot seat being formed with a central transmission hole, a certain portion of the circumference of the front end of the pivot seat being formed with an insertion notch, said roller skate structure being characterized in that:

a lateral side of the boot is formed with two through holes communicating with the cavities, each through hole having a diameter larger than the maximum diameter of the press rod;

the press rod is two-stepped, a stop ring being retained around the outer circumference of the small diameter section of the press rod, an end of the press rod having an extending driving post formed with outer thread and having a minimum diameter of the press rod;

the locating board of the locating seat is formed with an escape slot in the space, a lateral end of each pivot plate being formed with a stop through hole, the projecting post being formed with a slide through hole extending through the pivot plate;

two ends of the linking plate are respectively formed with a driving hole and a driven hole; and the stop body includes a stop head and a driven post extending from the end face of the stop head, the driven post having smaller diameter and being formed with outer thread, whereby the roller seat is fitted between the two pivot plates of the locating seat and fixed connected with the pivot shaft, the torque spring being fitted on the pivot shaft, the pivot shaft being fitted into the pivot holes of the locating seat and the transmission hole of the roller seat, the locating seat being positioned in the cavity with the stop through hole aligned with the through hole of the boot, the compression spring being fitted on the press rod, the press rod with the compression spring being fitted into the through hole of the boot and the stop through hole of the locating seat and extending out of the outer pivot plate of the locating seat by a certain length, the stop head of the stop body being fitted into the slide through hole of the locating seat with the driven post extending out of the projecting post by a certain length, the driving post being fitted into the driving hole of the linking plate, the driven post being fitted into the driven hole thereof, nuts being screwed onto the driving post and the driven post, so that the press rod is fixed connected with the stop body.

* * * * *